US007835659B2

(12) United States Patent
Moro et al.

(10) Patent No.: US 7,835,659 B2
(45) Date of Patent: Nov. 16, 2010

(54) IMAGE FORMING APPARATUS CAPABLE OF REDUCING NOISE ENERGY RADIATED OUTSIDE THE APPARATUS, METHOD OF DESIGNING FRAME, AND COMPUTER READABLE MEDIUM

(75) Inventors: Fuminori Moro, Toyokawa (JP); Shoichi Yoshikawa, Okazaki (JP); Atsuhiko Shimoyama, Tahara (JP); Takayuki Ito, Nagoya (JP)

(73) Assignee: Konica Minolta Business Technologies, Inc., Chiyoda-Ku, Tokyo (JP)

( * ) Notice: Subject to any disclaimer, the term of this patent is extended or adjusted under 35 U.S.C. 154(b) by 482 days.

(21) Appl. No.: 11/948,023

(22) Filed: Nov. 30, 2007

(65) Prior Publication Data

US 2009/0028598 A1 Jan. 29, 2009

(30) Foreign Application Priority Data

Jul. 24, 2007 (JP) ..... 2007-192249

(51) Int. Cl.
*G03G 21/20* (2006.01)
*G03G 15/00* (2006.01)

(52) U.S. Cl. ..... 399/91; 399/107; 181/201

(58) Field of Classification Search ..... 399/91, 399/107; 181/198, 201
See application file for complete search history.

(56) References Cited

U.S. PATENT DOCUMENTS 4,431,324 A * 2/1984 Keiter et al. ..... 400/689
4,636,101 A * 1/1987 Matsukura et al. ..... 400/690
7,158,734 B2 * 1/2007 Kawamata et al. ..... 399/91
7,583,912 B2 * 9/2009 Saito et al. ..... 399/107
7,684,726 B2 * 3/2010 Suzuki et al. ..... 399/107
7,710,616 B2 * 5/2010 Ishizuka ..... 358/498

FOREIGN PATENT DOCUMENTS

JP 2000-235396 A 8/2000
JP 2000235396 A * 8/2000
JP 2000-238369 9/2000
JP 2003-191569 7/2003

OTHER PUBLICATIONS

Notice of Grounds of Rejection issued in corresponding Japanese Application No. 2007-192249 dated Nov. 17, 2009, and an English Translation thereof.
Notice of Grounds of Rejection in JP 2007-192249 dated Jun. 9, 2009, and an English Translation thereof.

* cited by examiner

*Primary Examiner*—Robert Beatty
(74) *Attorney, Agent, or Firm*—Buchanan Ingersoll & Rooney PC

(57) ABSTRACT

In an image forming apparatus, a frame as an interior member is provided so as to oppose an exterior cover as an exterior member for controlling noise from an apparatus main body. An opening that is made up of a number of aperture regions is provided for allowing sound that is radiated to the exterior cover and reflected, to transmit toward the apparatus main body. By providing an opening in the frame or the like, it is possible to reduce noise energy radiated outside the apparatus in a simple manner.

4 Claims, 13 Drawing Sheets

IMAGE FORMING APPARATUS CAPABLE OF REDUCING NOISE ENERGY RADIATED OUTSIDE THE APPARATUS, METHOD OF DESIGNING FRAME, AND COMPUTER READABLE MEDIUM

This application is based on Japanese Patent Application No. 2007-192249 filed with the Japan Patent Office on Jul. 24, 2007, the entire content of which is hereby incorporated by reference.

BACKGROUND OF THE INVENTION

1. Field of the Invention

The present invention relates to an image forming apparatus, in particular, a structure of an interior member capable of controlling noise from a main body of an image forming apparatus, and to a method of designing a frame.

2. Description of the Related Art

Conventionally, it has been an important subject to prevent noise generated in an image forming apparatus from leaking outside.

FIG. 15 is an external structural view of a conventional image forming apparatus.

Referring to FIG. 15, a conventional image forming apparatus 1000 is provided with an exterior cover 45 on the front, back and lateral side faces so as to cover the entire apparatus main body for controlling the noise from the apparatus main body which is not illustrated in the drawing. In image forming apparatus 1000 shown in FIG. 15, a case in which a sheet feed tray 1030, a sheet discharge tray 16 and a display 1020 are provided as well as the exterior cover 45 is illustrated.

FIG. 16 is a diagram illustrating part of the structure of an apparatus main body of an image forming apparatus.

Referring to FIG. 16, a color printer is shown in which a color image is formed electrophotographically using a photoconductor 1 of a drum type serving as a latent image carrier, four developers configuring a developing unit 6, and an intermediate transfer belt 7*a* serving as an image carrier belt. In this context, description will be made only for principal parts of the image forming apparatus.

Specifically, there are provided photoconductor 1 of a drum type as one example of an image carrier, which is, for example, rotated for image formation; developing unit 6 including a plurality of, e.g., four developers, for forming toner images by development onto a moving face of photoconductor 1; and an intermediate transfer unit 7, which, for example, rotationally moves in synchronization with photoconductor 1, so that toner images sequentially formed on the moving face of photoconductor 1 are sequentially overlaid and transferred at a transfer position set around the moving face of photoconductor 1.

In photoconductor 1, an electric latent image according to an image signal, namely, an electrostatic latent image is formed for each color in response to image exposure by a laser beam 9 modulated by the image signal from a laser print head 8, or in response to optical printing, and then the latent image is visualized by development and formed into a toner image.

With regard to the development of an electric latent image, a toner image on photoconductor 1 is electrostatically transferred onto intermediate transfer belt 7*a* of intermediate transfer unit 7 by electrostatic absorption upon application of electric charge from a transfer roller 11 serving as a primary transfer unit.

A toner image resulting from sequential overlaying onto intermediate transfer belt 7*a*, electrostatic transferring, and image composition is then secondary-transferred electrostatically at once onto a transfer sheet fed from a sheet feed part 12*a* or the like at a transfer position set around the moving face by electrostatic absorption from a transfer roller 14 serving as a secondary transferring unit. Then the transfer sheet after the secondary transfer is passed through a fixing unit 15 to complete the image formation, and then discharged onto a sheet discharge tray 16.

Both the primary transfer and the secondary transfer may adopt transfer methods other than the electrostatic transfer, corresponding to a developing method employed in the image formation. Fixing unit 15 may also be adapted to the developing method, and it is sometimes unnecessary.

For color image formation, the plurality of developers develop an electrostatic latent image with toners 2*a* to 5*a* of respective colors, yellow, magenta, cyan and black, respectively, and in the present example, fixing unit 15 employing heating or pressuring, or both is used in association with the use of powder resin toners. Use of the developer for black is not essential.

A color image may be formed using four or more developers. The present invention is applicable to the case where two or more developers are alternately used without limited to the case where a color image is formed.

Photoconductor 1 forms a process unit 36 having a charging charger 34 and a cleaner 35.

FIG. 17 is a perspective view of an apparatus main body of an image forming apparatus.

Referring to FIG. 17, here is shown a perspective view of the apparatus main body of the image forming apparatus in which exterior cover 45 is removed. Here, the apparatus main body is provided, and a frame 1100 as an interior member securing and supporting the apparatus main body is illustrated.

Here is also shown developing unit 6 having four developers as described above.

Also shown is the case in which various motors for driving the apparatus main body are arranged with respect to frame 1100. Specifically, motors M1 to M4 for respectively driving above-mentioned developing unit 6, intermediate transfer belt 7*a*, transfer roller 11 and the like are arranged. Also a fan FN is arranged.

Since the rotation mechanism based on these motors M1 to M4 and the like and driving of fan FN and the like generate noises, a method of increasing transmission loss of sound by increasing surface density of the exterior member by increasing the thickness or mass of the exterior cover as an exterior member for controlling noises, or a method of bonding a sound absorbing material to the exterior member have been conventionally adopted.

Also known is a method of reducing noises by forming the exterior member of a laminate in which a solid layer and an air layer are alternately laminated, or employing a hollow double wall structure.

Further, in Japanese Laid-Open Patent Publication No. 2000-235396, a method of reducing noises by designing the exterior member to constitute a HelmHoltz resonator is disclosed.

However, in such conventional noise reduction structures, the size or weight of the apparatus may be increased, and the costs may increase from the viewpoint of material because the method is based on increasing the thickness or weight of the exterior member.

Also in the method of using a sound absorbing material, ensuring of a space for bonding the sound absorbing material, as well as the material cost of the sound absorbing material, is required.

Generally, there is correlation between the thickness of a sound absorbing material and the sound absorbing performance, so that the size of apparatus may be increased.

Further, in the exterior member as described above, employing the laminate structure or hollow double wall structure is disadvantageous in terms of cost, and may increase the size and weight of apparatus.

Also in the case where a HelmHoltz resonator is configured in the exterior member, similar problems arise. In the case of HelmHoltz resonator, there is an additional problem that the frequency of the sound to be absorbed is limited, and the design may become complicated.

SUMMARY OF THE INVENTION

The present invention was made to solve the above-mentioned problems, and it is an object of the present invention to provide an image forming apparatus capable of reducing noise energy radiated outside the apparatus by a simple system.

It is another object of the present invention to provide a method of designing a frame capable of reducing noise energy radiated outside the apparatus by a simple system, and a computer readable medium.

An image forming apparatus according to the present invention includes an exterior member for controlling noise from an apparatus main body; and an interior member to be mounted with an internal device that generates noise or vibration and constitutes the apparatus main body. The interior member is disposed at a predetermined interval with respect to the exterior member, and has an opening for allowing sound that is radiated from the internal device to the exterior member and reflected, to transmit toward the apparatus main body.

Preferably, the opening is provided near the internal device.

Preferably, the opening is provided at a position where sound from the apparatus main body side does not directly leaks.

Preferably, an aperture ratio of the opening provided in the interior member is set at 0.2 or less.

A method of designing a frame according to the present invention is a method of designing a frame to be mounted with an internal device constituting an apparatus main body and generating noise or vibration, inside an exterior member of an image forming apparatus, the method including the steps of: extracting regions where no parts are arranged in the frame; extracting a region from which an internal noise source is visible according to arrangement of parts when an aperture is made in the frame; excluding the region from which an internal noise source is visible from the regions where no parts are arranged, to identify a functionally inessential region; and designing an opening in the functionally inessential region. The step of designing an opening includes the steps of: setting an aperture region in the functionally inessential region; calculating an aperture ratio of the set aperture region relative to the entire area of the frame; simulating a sound pressure level to be attenuated based on the calculated aperture ratio; determining whether or not the simulated sound pressure level to be attenuated satisfies a predetermined condition; when the sound pressure level to be attenuated satisfies the predetermined condition as a result of the simulation, determining whether or not the set aperture ratio of the aperture region falls within a predetermined range according to a strength condition of the frame; and when the set aperture ratio of the aperture region is within the predetermined range, setting the selected aperture regions as the opening.

A computer readable recording medium according to the present invention is a computer readable recording medium storing a program for causing a computer to execute processes to design a frame to be mounted with an internal device constituting an apparatus main body and generating noise or vibration, inside an exterior member of an image forming apparatus, the processes include the steps of: extracting regions where no parts are arranged in the frame; extracting a region from which an internal noise source is visible according to arrangement of parts when an aperture is made in the frame; excluding the region from which an internal noise source is visible from the regions where no parts are arranged, to identify a functionally inessential region; and designing an opening in the functionally inessential region. The step of designing an opening includes the steps of: setting an aperture region in the functionally inessential region; calculating an aperture ratio of the set aperture regions relative to the entire area of the frame; simulating a sound pressure level to be attenuated based on the calculated aperture ratio; determining whether or not the simulated sound pressure level to be attenuated satisfies a predetermined condition; when the sound pressure level to be attenuated satisfies the predetermined condition as a result of the simulation, determining whether or not the set aperture ratio of the aperture region falls within a predetermined range according to a strength condition of the frame; and when the set aperture ratio of the aperture region is within the predetermined range, setting the set aperture region as the opening.

The image forming apparatus according to the present invention has an opening for allowing reflected sound that is radiated toward the exterior member and reflected in the interior member to which internal equipment is attached, to transmit toward the side of the apparatus main body. Therefore, it is possible to reduce noise energy radiated outside the apparatus by a simple system.

The foregoing and other objects, features, aspects and advantages of the present invention will become more apparent from the following detailed description of the present invention when taken in conjunction with the accompanying drawings.

DESCRIPTION OF THE PREFERRED EMBODIMENTS

Figure 1:
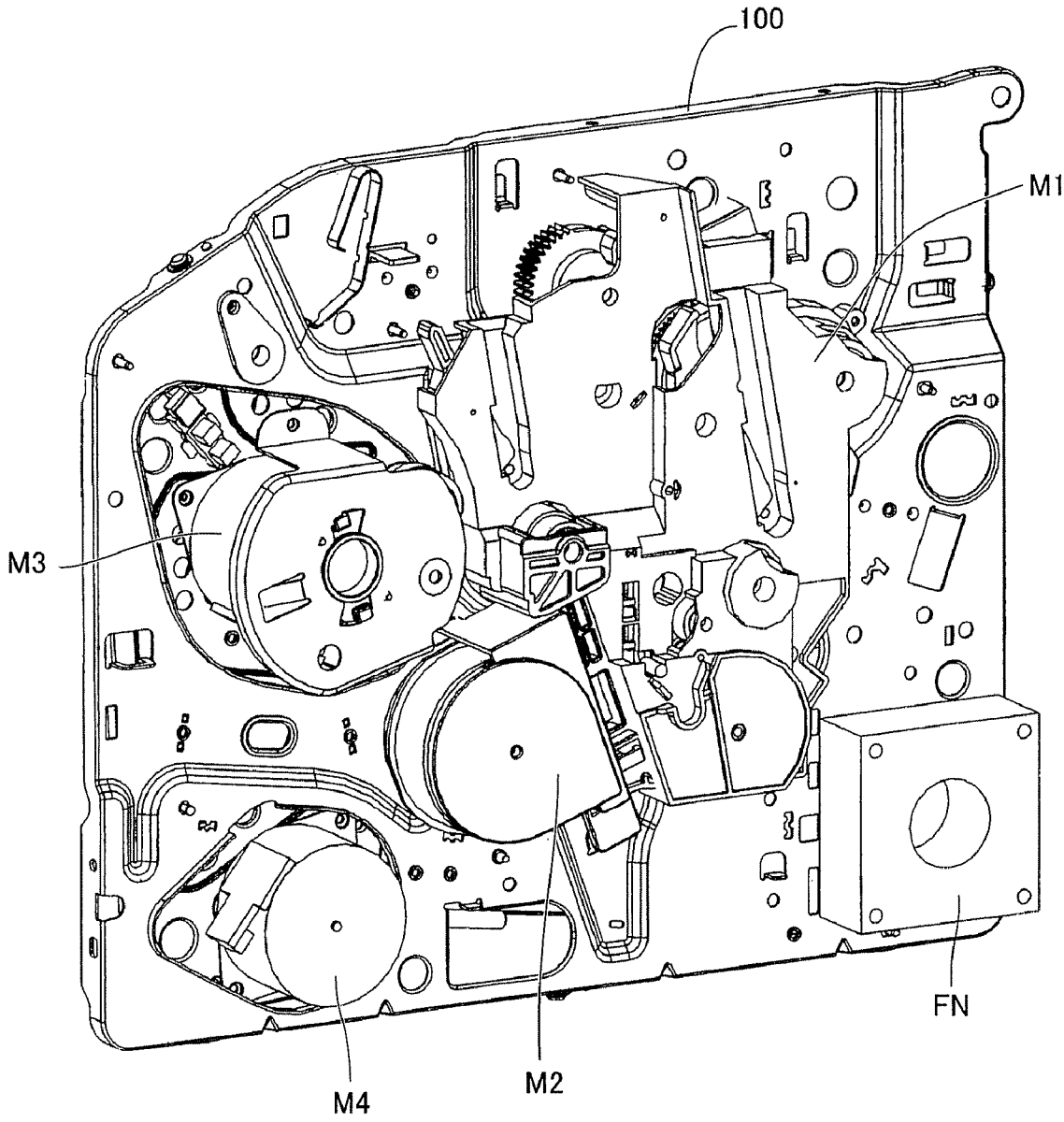
FIG. 1 is a diagram illustrating part of an interior member according to an embodiment of the present invention.

In the following, an embodiment of the present invention will be described with reference to attached drawings. In the following description, like parts and elements are designated by like reference numerals. Such parts and elements have like names and functions.

A color printer, which is an image forming apparatus according to the present invention, reduces noise energy radiated outside the apparatus by processing an interior member. Specifically, the interior member is provided with a lot of aperture regions which are to become an opening, as compared with a conventional interior member.

FIG. 1 is a diagram illustrating part of the interior member according to an embodiment of the present invention.

Figure 15:
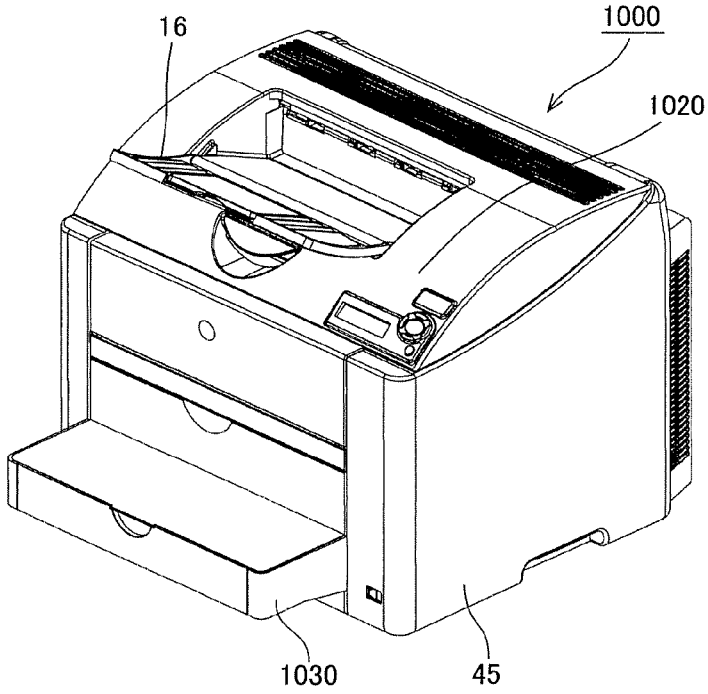
FIG.15 PRIOR ART
FIG. 15 is an external structure view of a conventional image forming apparatus.
Figure 16:
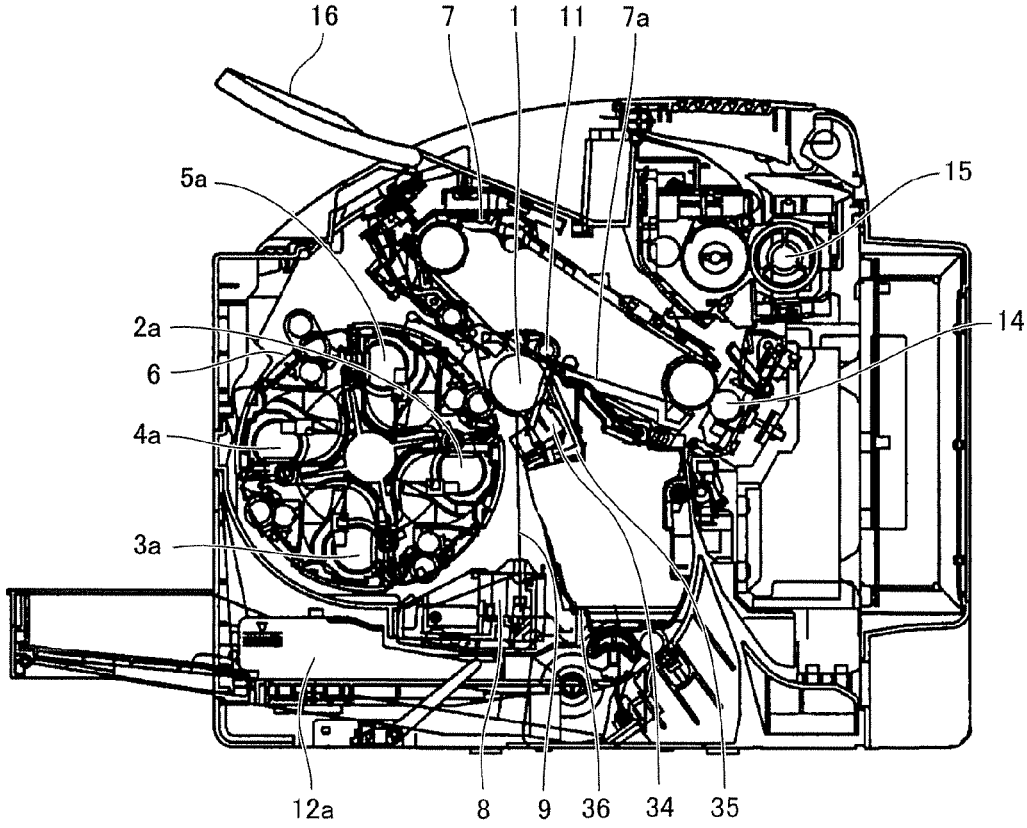
FIG.16 PRIOR ART
FIG. 16 is a diagram illustrating part of a structure of an apparatus main body of an image forming apparatus.

The external structure view of the image forming apparatus and the structure of the apparatus main body and the like are the same as those illustrated in FIGS. 15 and 16, so that the detailed description will not be repeated.

Referring to FIG. 1, here is shown a frame 100 which is the interior member according to the embodiment of the present invention. Here, the surface opposing to an exterior cover (not shown) for controlling noise from the apparatus main body is shown (hereinafter, also referred to as a superficial face).

A predetermined interval is provided between frame 100 as the interior member and the exterior cover, so that vibration generated in the interior member will not be directly transmitted to frame 100.

In the illustrated case, the interior member is mounted with motors M1 to M4 as described above. Motors M1 to M4 are provided between frame 100 and the exterior cover as an exterior member that is not illustrated.

Figure 17:
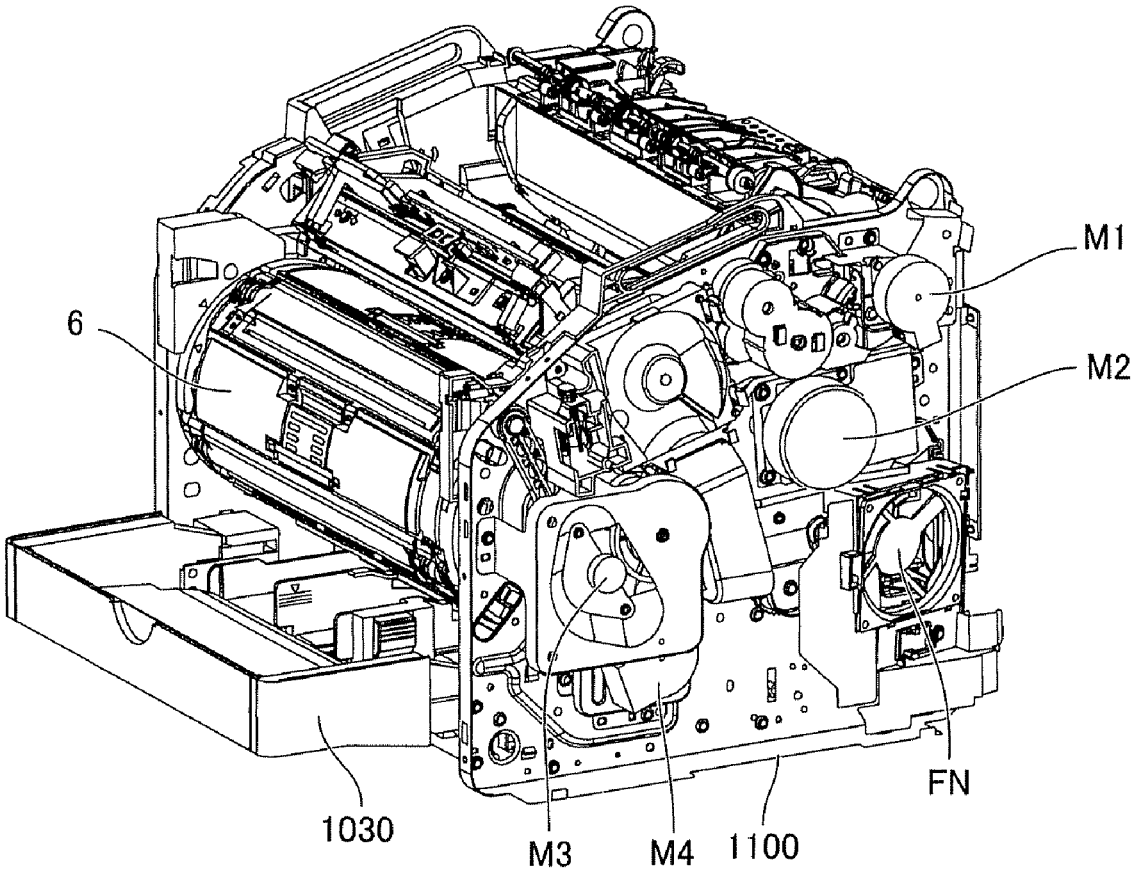
FIG.17 PRIOR ART
FIG. 17 is a perspective view of an apparatus main body of an image forming apparatus.

Although the positions of motors M1 to M4 on frame 100 shown in FIG. 1, and the positions of motors M1 to M4 fixed to frame 1100 as described with reference to FIG. 17 are slightly different in layout, they have similar functions, and drive developing unit 6, intermediate transfer belt 7*a*, transfer roller 11, or the like described with reference to FIG. 16 via a belt, gear, or the like.

Figure 2:
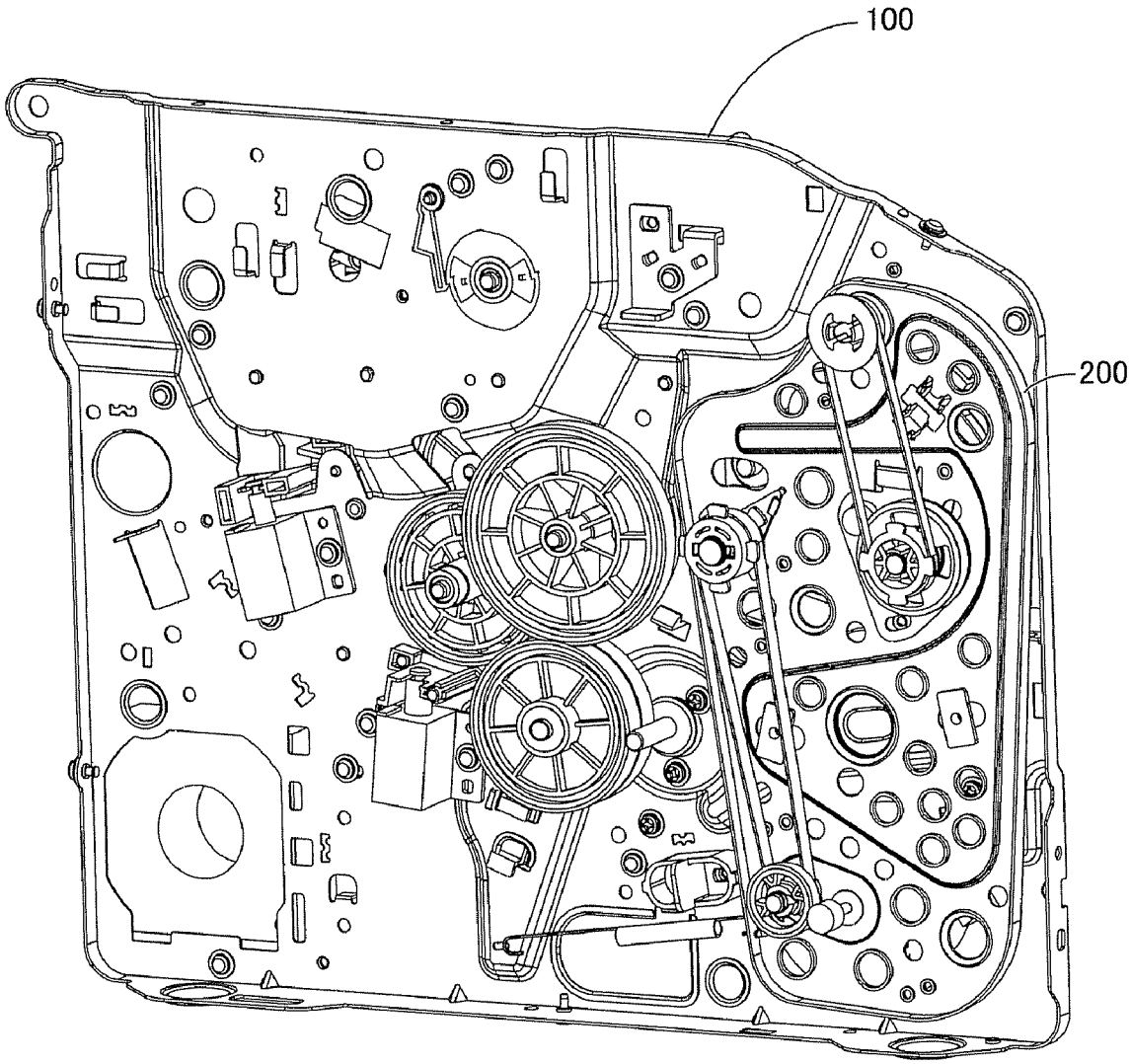
FIG. 2 is a diagram illustrating the back side of a frame of the interior member according to the embodiment of the present invention.

Referring to FIG. 2, in the illustrated case, a mounting member 200 is attached on the back face side of frame 100 of the interior member according to the embodiment of the present invention. Referring to FIG. 1 as well, motors M3 and M4 are designed to be hung from frame 100 while fixed to mounting member 200 to oscillate integrally with internal parts.

In FIG. 2, a belt is used for transmission of driving from motors M3 and M4, and a specific part is transmittingly driven via the belt.

Using FIG. 3, frame 100 will be described.

Using FIG. 4, conventional frame 1100 will be described.

Figure 3:
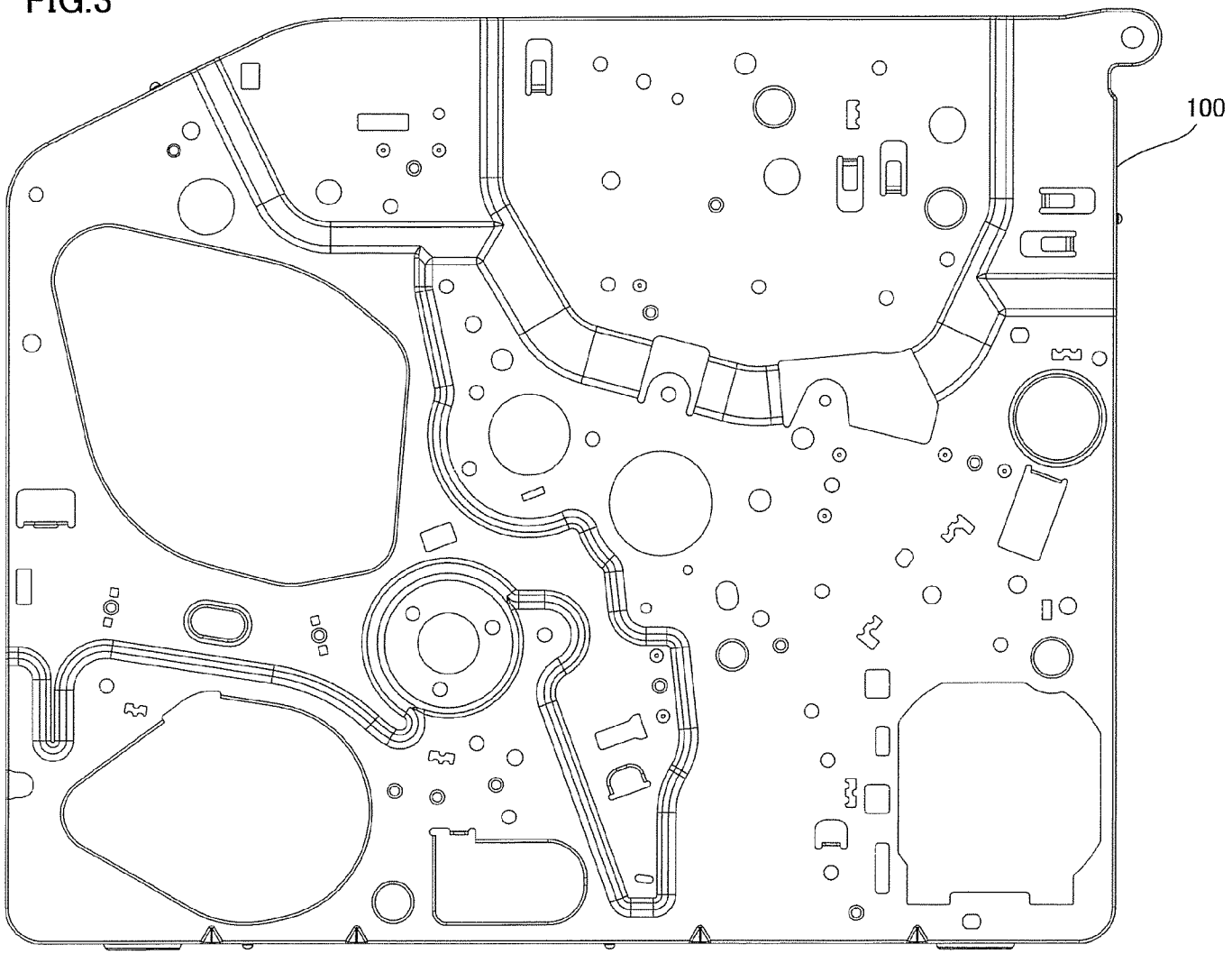
FIG. 3 is a diagram illustrating the frame.
Figure 4:
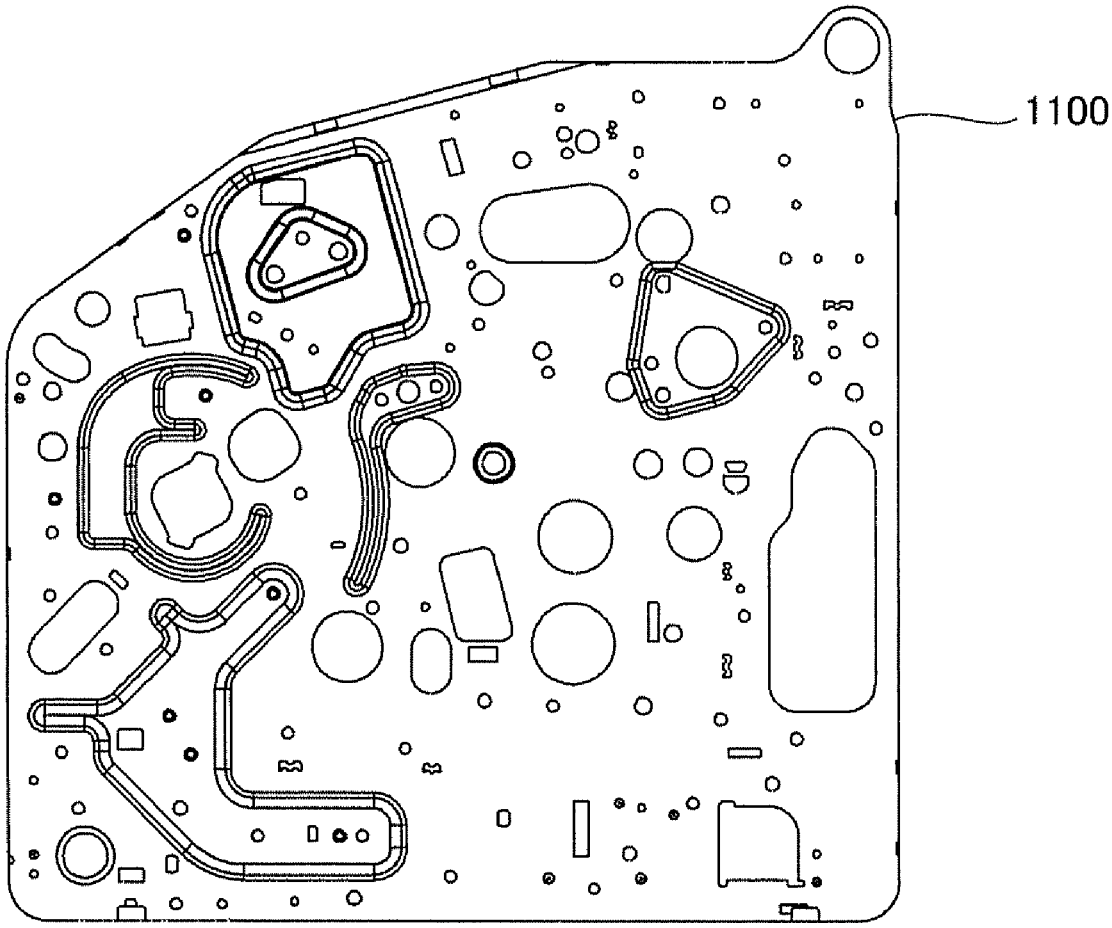
FIG. 4 is a diagram illustrating a conventional frame.

Referring to FIGS. 3 and 4, frame 100 according to the embodiment of the present invention is provided with an opening having a relatively large area as compared to conventional frame 1100.

Although it appears that an opening formed of a number of aperture regions is provided in frame 1100, they are actually provided as aperture regions for screwing or fixing metal parts, and most of such aperture regions are closed when corresponding parts are combined.

In FIG. 4, the aperture ratio of the opening formed by the aperture regions provided in frame 1100 when combined with parts, namely, the ratio of area of the opening relative to the entire area of the frame is 2.4%.

On the other hand, referring to FIG. 3, the substantial aperture ratio of the opening when parts are combined with frame 100 according to the embodiment of the present invention is 7.8%.

Using FIG. 5, motors M3 and M4 and mounting member 200 to which motors M3 and M4 are directly mounted will be described.

Figure 5:
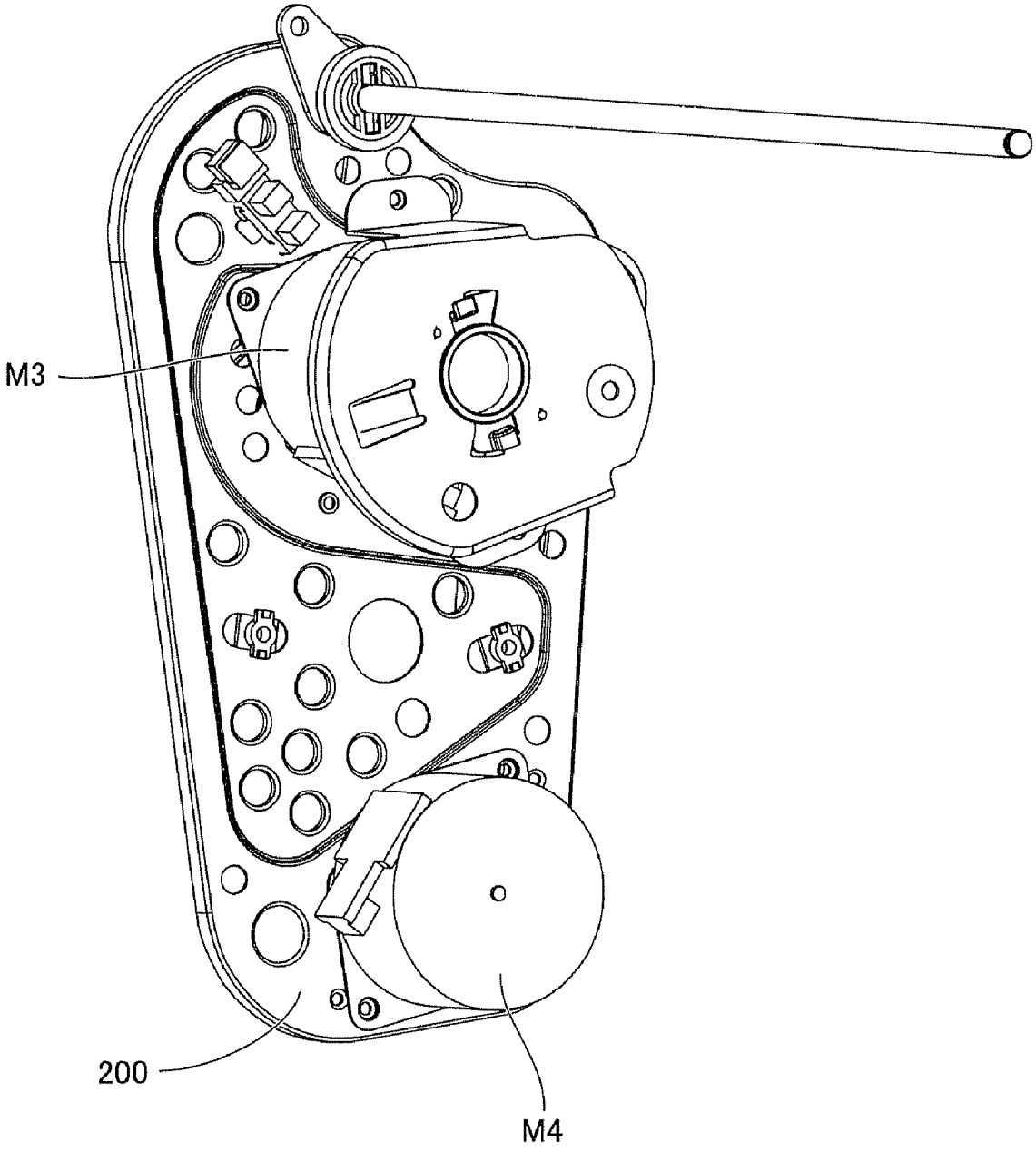
FIG. 5 is a diagram illustrating motors and a mounting member to which the motors are directly mounted.

Referring to FIG. 5, here is shown the face that is fixed while being in contact with the back face side of frame 100.

Using FIG. 6, the back face side of mounting member 200 to which motors M3, M4 are directly mounted will be described.

Figure 6:
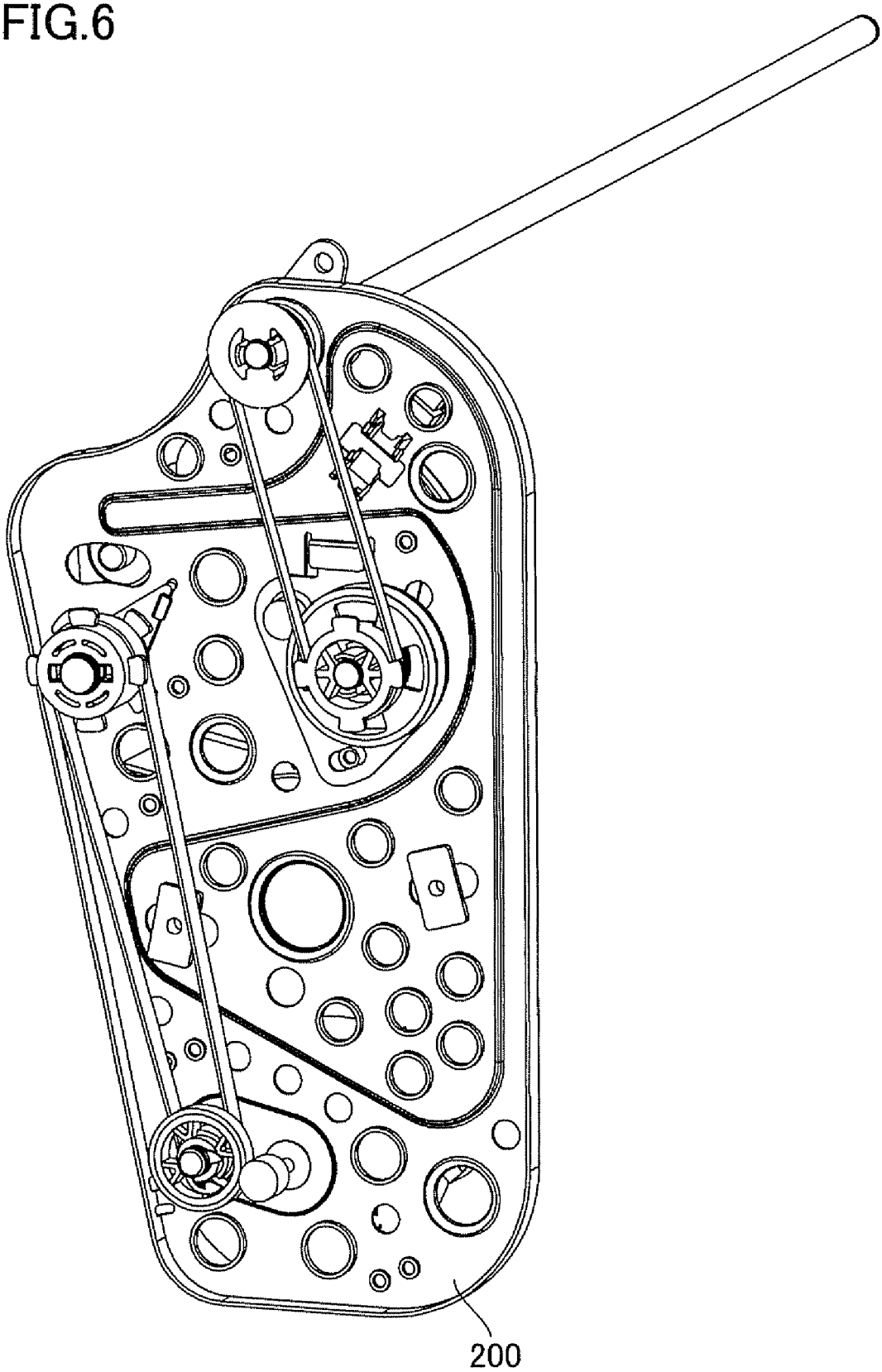
FIG. 6 is a diagram illustrating the back face side of the mounting member to which the motors are directly mounted.

As shown in FIGS. 5 and 6, also in mounting member 200, a number of aperture regions are provided in addition to apertures for screwing or fixing metal parts for mounting motors M3, M4 and the like.

Using FIG. 7, mounting member 200 will be described.

Using FIG. 8, conventional mounting member 1200 will be described.

Figure 8:
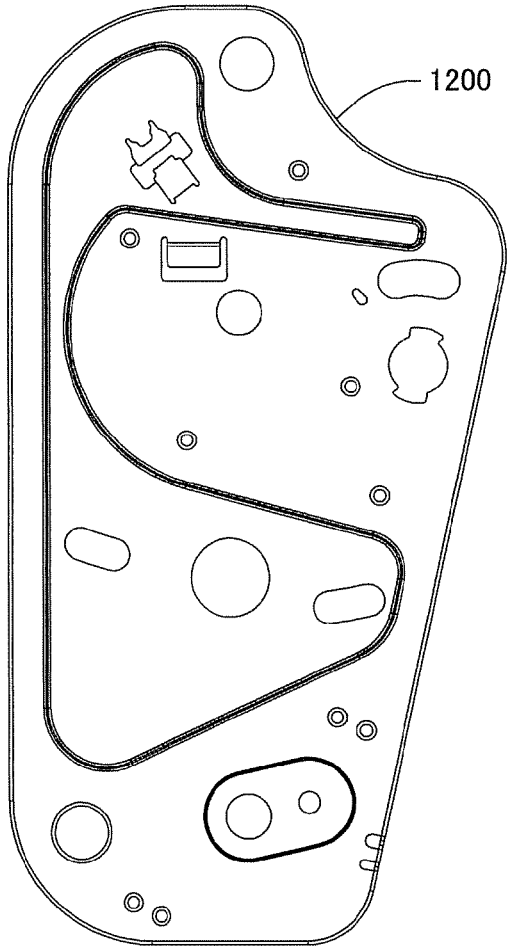
FIG. 8 is a diagram illustrating a conventional mounting member.

Referring to FIG. 8, the conventional mounting member is merely provided with apertures for screwing or fixing metal parts, and the aperture regions are substantially closed.

Figure 7:
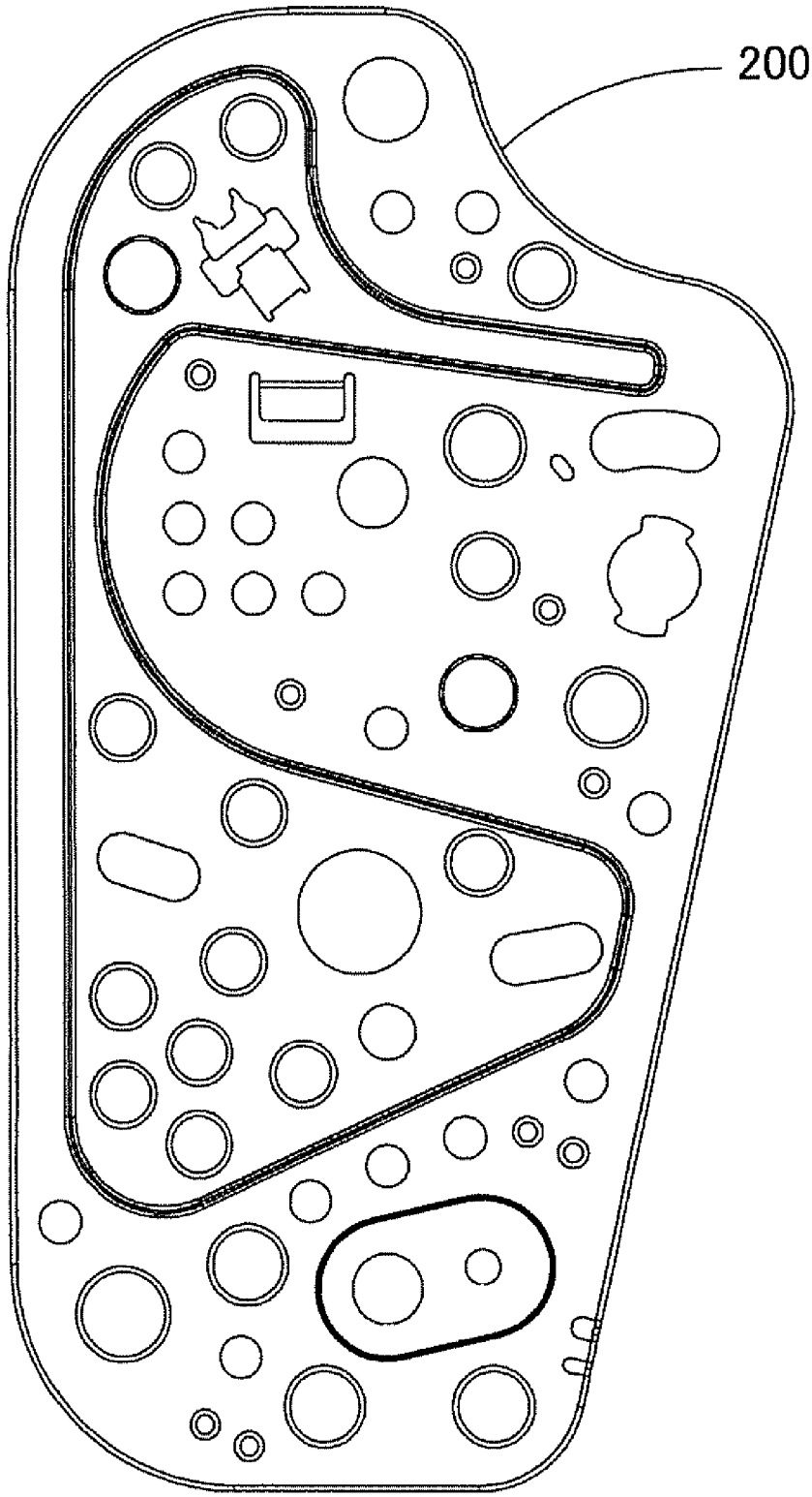
FIG. 7 is a diagram illustrating the mounting member.

Referring to FIG. 7, in comparison to conventional mounting member 1200, the mounting member according to the embodiment of the present invention is provided with a number of aperture regions forming an opening in addition to the apertures for screwing or fixing metal parts.

In the present example, there is shown a case in which aperture regions having various areas are dispersedly provided to form an opening. This structure is employed to secure the strength of the mounting member while ensuring the area of the opening by providing the aperture regions dispersedly.

Further, by providing a number of aperture regions near the positions where motors M3, M4 are mounted, it is possible to increase the attenuation effect of noise.

In FIG. 7, the aperture ratio of the opening formed by the aperture regions provided in mounting member 200 when combined with parts, namely, the ratio of area of the opening relative to the entire area of the mounting member is 6.9%.

On the other hand, referring to FIG. 8, the substantial aperture ratio of the opening when parts are combined with conventional mounting member 1200 is 1.2%.

Using FIG. 9, an operation principle of the acoustic attenuating structure according to the embodiment of the present invention will be described.

Figure 9:
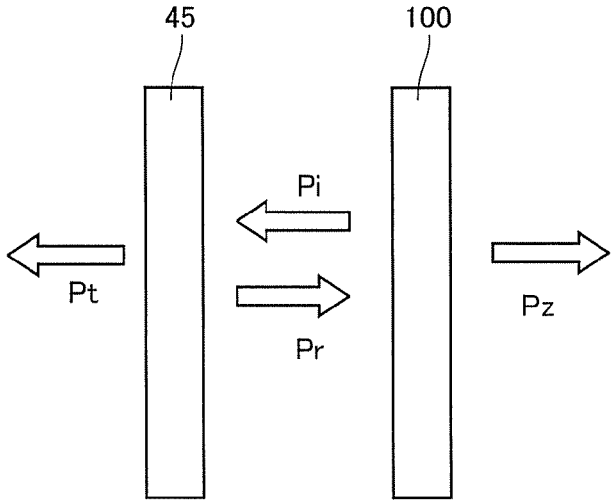
FIG. 9 is a diagram illustrating an operation principle of an acoustic attenuating structure according to the embodiment of the present invention.

Referring to FIG. 9, here is shown exterior cover 45 as an exterior member, and frame 100 as an interior member.

Here, frame 100 is considered to be a noise source because a source of noise or vibration such as a motor and a fan is fixed to frame 100.

Here, Pi represents incident acoustic energy radiated from frame 100 to exterior cover 45 as an exterior member. The noise generated from frame 100 spreads in various directions; however, in this context, the energy that reaches exterior cover 45 is considered.

Part of the energy having reached exterior cover 45 transmits the same and is recognized as noise outside the apparatus.

Pt represents transmitted energy having transmitted exterior cover 45.

Part of the energy having reached exterior cover 45 is reflected to return in the direction of frame 100. Pr represents reflected acoustic energy reflected at exterior cover 45.

Upon reaching frame 100, part of reflected acoustic energy Pr transmits to the apparatus main body, while the remaining part is reflected and travels again toward exterior cover 45.

Pz represents transmitted acoustic energy that enters inside the apparatus main body.

Noise that reaches outside the apparatus can be considered as the summation of the energy that transmits to the outside by repetition of transmission and reflection.

It is assumed that acoustic energy enters perpendicularly to each member. It is also assumed that acoustic energy will not enter from around each member, and transmitted acoustic energy Pz that enters inside the apparatus main body is attenuated inside the apparatus main body.

Constants regarding materials of exterior cover 45 and frame 100 are referred to as α and β respectively. The aperture ratio, which is the ratio of area of the opening relative to the entire area of frame 100 where the opening is provided, is referred to as q.

In the case where reflection between exterior cover 45 and frame 100 is repeated infinitely, the relationship between incident acoustic energy Pi and transmitted acoustic energy Pt can be derived as shown by the following equation using a relational expression shown in "Soon Seigyo Kogaku Handobukku (Noise control engineering handbook)" (Institute of Noise Control Engineering of Japan, ed., Gihodo Shuppan Co., Ltd., April, 2001), and the like.

$$Pt = \frac{(1-\alpha)^2}{1-\{\alpha\beta(1-q)\}^2} \times Pi \qquad \text{(Equation 1)}$$

α, β are represented by the following equations.

$$\alpha = \frac{\frac{j\omega m_A}{2\rho c}}{1+\frac{j\omega m_A}{2\rho c}} \qquad \text{(Equation 2)}$$

$$\beta = \frac{\frac{j\omega m_B}{2\rho c}}{1+\frac{j\omega m_B}{2\rho c}}$$

Here, $m_A$ and $m_B$ respectively represent area densities of exterior cover 45 and frame 100, ω represents an angular frequency, ρ represents an air density, and c represents an acoustic velocity.

In general, the relation of the sound pressure level used as a unit of amplitude of noise is represented by the following equation where the incident sound pressure level is Lpi, and the transmitted sound pressure level is Lpt.

(Equation 3)

Sound pressure level: logarithm of ratio of sound pressure p to reference value of sound pressure po $$Lp = 20\log_{10}\frac{p}{po}$$

$$Lpt = 20\log_{10}\frac{pt}{po}$$

$$Lpi = 20\log_{10}\frac{pi}{po}$$

$$\frac{pt}{pi} = \sqrt{\frac{Pt}{Pi}} = \frac{1-\alpha}{\sqrt{1-\{\alpha\beta(1-q)\}^2}}$$

$$\begin{aligned} Lpt &= 20\log_{10}\frac{pt}{po} \\ &= 20\log_{10}\frac{1-\alpha}{\sqrt{1-\{\alpha\beta(1-q)\}^2}}\cdot\frac{pi}{po} \\ &= 20\log_{10}\frac{1-\alpha}{\sqrt{1-\{\alpha\beta(1-q)\}^2}} + 20\log_{10}\frac{pi}{po} \end{aligned}$$

$$Lpt = Lpi + 20\log_{10}\frac{1-\alpha}{\sqrt{1-\{\alpha\beta(1-q)\}^2}}$$

Acoustic transmission loss R is given by the following equation $$\begin{aligned} R &= 10\log_{10}\left(\frac{Pi}{Pt}\right) \\ &= 10\log_{10}\left[1+\left(\frac{\omega m}{2\rho c}\right)^2\right] \\ &\fallingdotseq 20\log_{10}(fm) - 43 \end{aligned} \qquad \text{(Equation 4)}$$

Here, when exterior cover 45 is formed of ABS resin (density 1.1 g/mm$^3$) having a thickness of 2.5 mm, surface density $m_A$ is 2.75 kg/mm$^2$.

When frame 100 is formed of a steel plate (density 7.6 g/mm$^3$) having a thickness of 1.0 mm, surface density $m_B$ is 7.6 kg/mm$^2$.

Acoustic transmission loss Ra of the exterior cover is given by the following equation.

$$Ra = 10\log_{10}\frac{1}{(1-\alpha)^2} = 20\log_{10}(fm_A) - 43 \qquad \text{(Equation 5)}$$

Acoustic transmission loss Rb of frame 100 is given by the following equation.

$$Rb = 10\log_{10}\frac{1}{(1-\beta)^2} = 20\log_{10}(fm_B) - 43 \qquad \text{(Equation 6)}$$

Using FIG. 10, difference in sound pressure level between the case where aperture ratio q is zero and the case where aperture ratio q is varied will be described.

Figure 10:
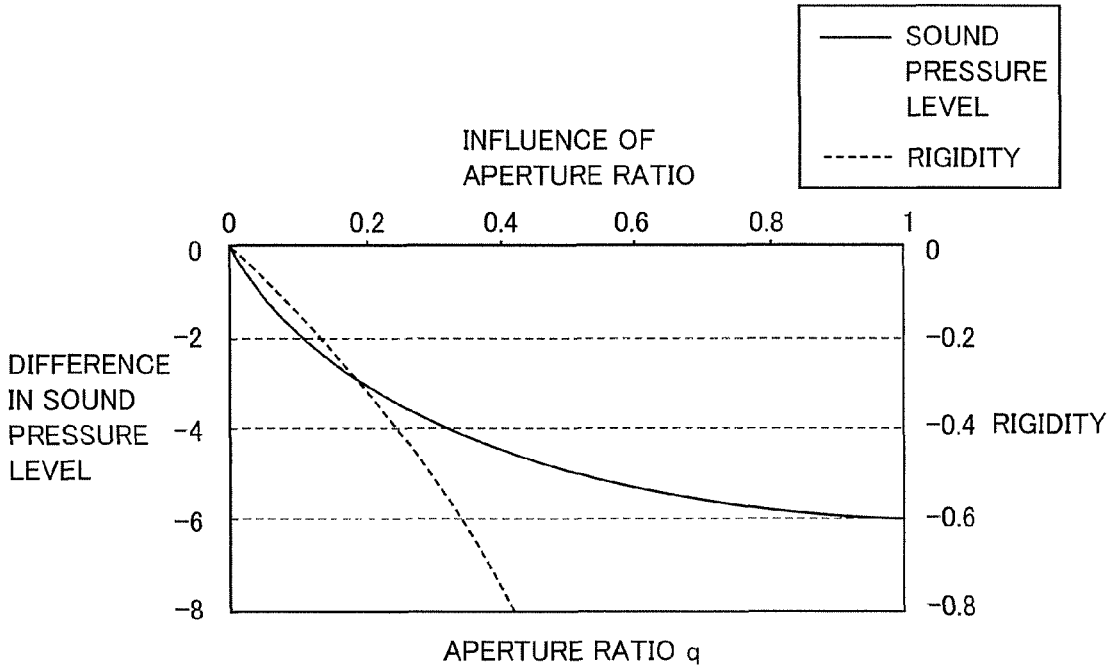
FIG. 10 is a graph showing difference in sound pressure level between the case where aperture ratio q is 0 and the case where aperture ratio q is varied.

Referring to FIG. 10, the left vertical axis represents the difference in sound pressure level. The horizontal axis represents the aperture ratio.

As shown in FIG. 10, the larger aperture ratio q is, the larger the difference in sound pressure level is. In other words, the acoustic attenuation effect becomes higher.

On the other hand, the right vertical axis represents the rigidity proportion of the frame at aperture ratio q of zero and being subject to the influence of aperture ratio. A rigidity characteristic is shown by the dotted line, and the larger aperture ratio q is, the lower the rigidity of frame is.

Therefore, aperture ratio q and the frame rigidity (strength) are in a trade-off relationship.

In FIG. 10, a simulation is carried out at a noise frequency of 500 Hz.

Using FIG. 11, difference in sound pressure level when aperture ratio q is varied at a noise frequency of 1000 Hz will be described.

Figure 11:
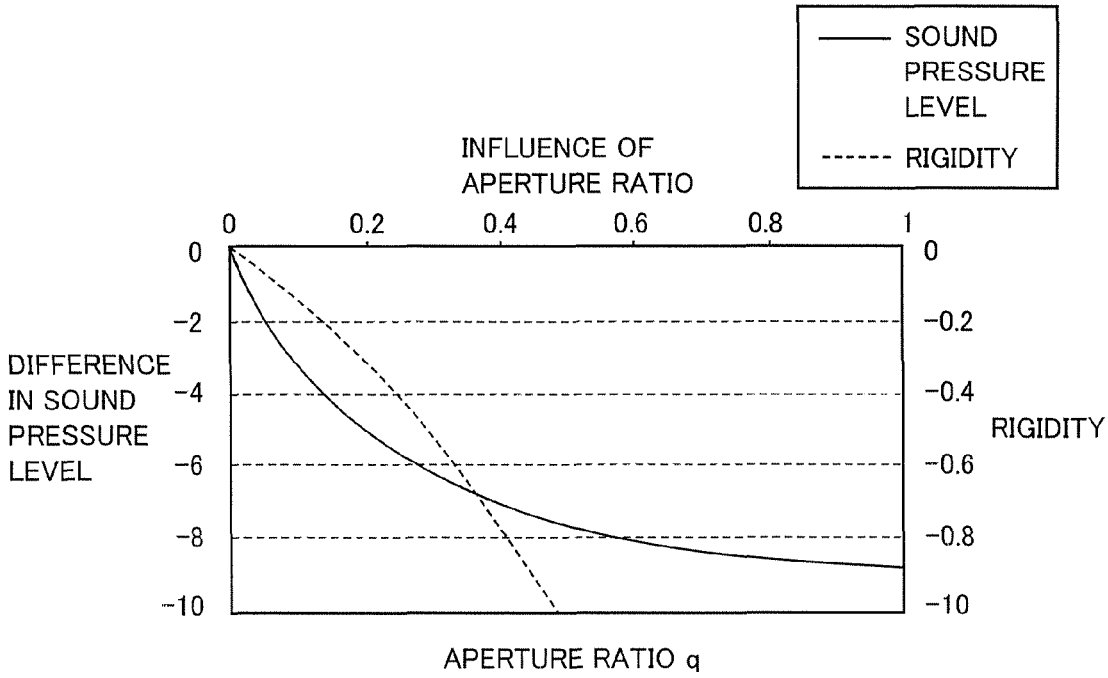
FIG. 11 is a graph showing difference in sound pressure level when aperture ratio q is varied at a noise frequency of 1000 Hz.

Referring to FIG. 11, it can be seen that the higher the noise frequency is, the greater the influence of aperture ratio is, as shown here. As to the rigidity characteristic, it is the same as the rigidity characteristic shown by the dotted line in FIG. 10.

In this example, description has been made for the simulations in which noise frequencies are 500 Hz and 1000 Hz, however, a similar effect can be expected for the case where a noise frequency other than the above is used.

Using FIG. 12, a result of comparing sound pressure levels measured at the time of driving the mounted motors, for the frame according to the embodiment of the present invention and the conventional frame will be described.

Specifically, in the measurement of frame 100 according to the embodiment of the present invention and conventional frame 1100, measurement was conducted while mounting member 200 was mounted, respectively.

Figure 12:
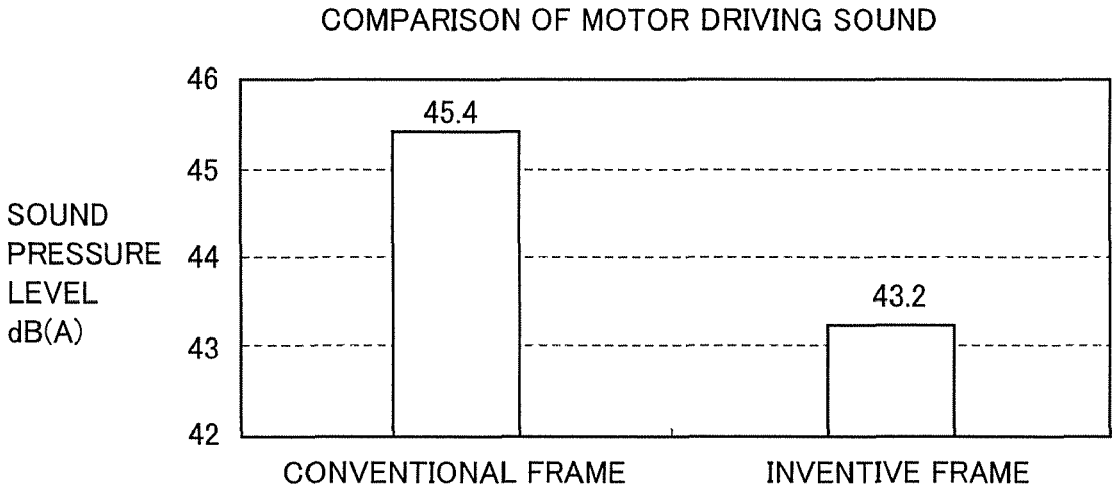
FIG. 12 is a graph showing comparison result of pressure level measured when mounted motors are driven, for a frame according to the embodiment of the present invention and a conventional frame.

As shown in FIG. 12, in the conventional frame, a sound pressure level of 45.4 dB was measured as the motor driving sound. On the other hand, in the frame of the present invention, a sound pressure level of 43.2 dB was measured as the motor driving sound. Therefore, the difference was 2.2 dB.

It is generally recognized that a human being can perceive a difference of 1 dB by sound pressure level, and hence the result of measurement shown in FIG. 12 is at a level where the effect can be sufficiently recognized.

Using FIG. 13, a result of comparing sound pressure levels measured at the time of driving the mounted motors, for the mounting member according to the embodiment of the present invention and the conventional mounting member will be described.

Specifically, in the measurement of mounting member 200 according to the embodiment of the present invention and conventional mounting member 1200, measurement was conducted while frame 100 was mounted, respectively.

Figure 13:
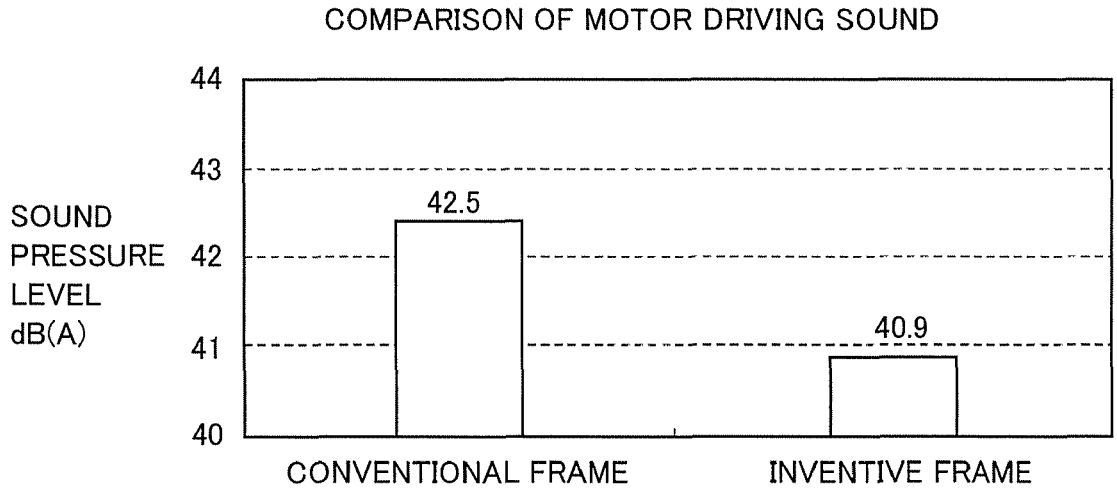
FIG. 13 is a graph showing comparison result of pressure level measured when mounted motors are driven, for a mounting member according to the embodiment of the present invention and a conventional mounting member.

As shown in FIG. 13, in conventional mounting member 1200, a sound pressure level of 42.5 dB was measured as the motor driving sound. On the other hand, in mounting member 200 of the present invention, a sound pressure level of 40.9 dB was measured as the motor driving sound. Therefore, the difference was 1.6 dB.

Therefore, also in this configuration, the effect can be sufficiently recognized based on the measurement result shown in FIG. 13.

As described above, in the image forming apparatus according to the present invention, a frame or a mounting member which is an interior member is provided so as to oppose exterior cover 45 which is an exterior member controlling noise from the apparatus main body. Then, an opening formed of a number of aperture regions is provided for allowing the sound radiated toward the exterior member and reflected, to transmit toward the apparatus main body. By providing an opening in the frame and the like, it is possible to reduce noise energy radiated outside the apparatus in a simple system.

Using FIG. 14, a designing method when an opening is provided in a frame according to the embodiment of the present invention will be described.

Figure 14:
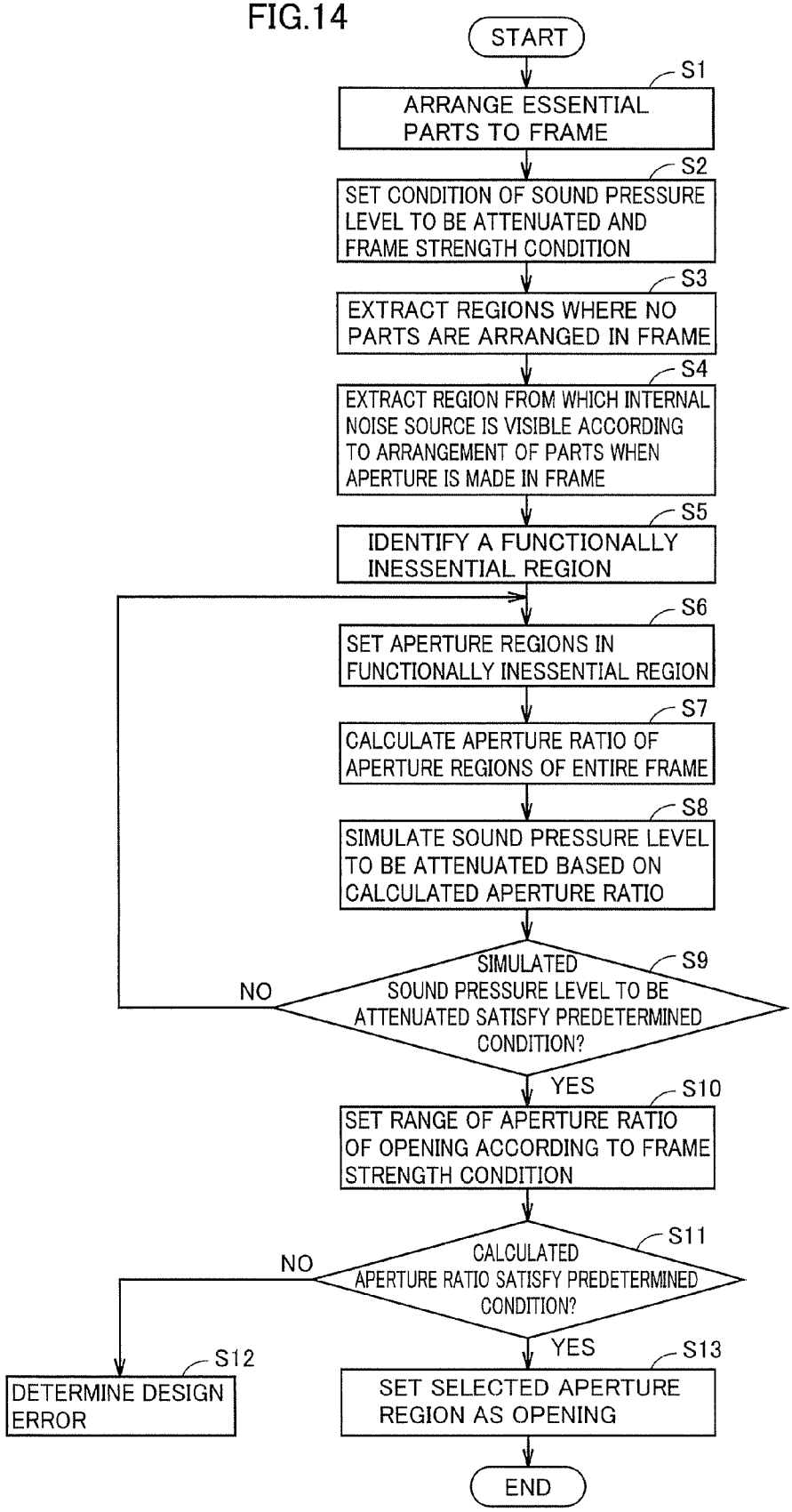
FIG. 14 is a flowchart illustrating a designing method when an opening is provided in the frame according to the embodiment of the present invention.

Referring to FIG. 14, first, essential parts are arranged in a designed frame before provision of the opening (step S1).

Next, the condition of sound pressure level to be attenuated and condition of frame strength are set (step S2).

In the frame, regions where no parts are arranged are extracted (step S3).

A region from which a source of noise in the interior is visible according to the arrangement of parts when an aperture is made in the frame is extracted (step S4).

On the apparatus main body side (interior) of the image forming apparatus, a mechanism part for carrying out sheet feeding operation, a clutch for controlling rotation/stop of a convey roller, and a solenoid which is an actuator for drawing in/pushing out a movable piece by electromagnetic force are expected to become internal noise sources. Therefore, a region from which such a noise source is visible is extracted by checking whether such an internal noise source is visible when an aperture, is made. To be more specific, as one example, an angle formed by a line linking any point in the aperture made in the frame and an internal noise source, and a normal line of the frame is measured, and whether the measured angle falls within a predetermined angle range is determined. When it is within the predetermined angle range, it can be determined that the region is one from which the internal noise source is visible. For example, the predetermined angle range may be set to 0 to 75 degrees.

A region from which an internal noise source is visible is excluded from the regions where no parts are arranged, to identify the region that is functionally inessential (step S5).

By extracting the region where noise may enter from the apparatus main body side (interior) and excluding that region from the region where the opening is to be provided, it is possible to control noise from the apparatus main body side (interior).

In the functionally inessential region, an aperture regions are selected (step S6). The aperture regions are various in size, and may be selected by designation made by a user.

Then, the aperture ratio is calculated based on the area of aperture regions in the entire frame (step S7).

Attenuating sound pressure level is simulated based on the calculated aperture ratio (step S8).

Then, whether the sound pressure level to be attenuated as a result of the simulation satisfies a predetermined condition is determined (step S9).

Specifically, whether the condition of sound pressure level to be attenuated, set in step S2, is satisfied or not, for example, whether the difference in sound pressure level between the case where the opening is provided and the case where the opening is not provided is, for example, 1 dB or larger or not, is determined.

In step S9, when the predetermined condition is not satisfied, the flow returns to step S6 where aperture regions are selected again in the functionally inessential region.

On the other hand, in step S9, when the predetermined condition is satisfied, a range of aperture ratio of the opening is set in accordance with the strength condition of the frame (step S10).

Specifically, from the dotted-line chart of the rigidity characteristic shown in FIG. 10 or FIG. 11, the aperture ratio according to the rigidity of frame is calculated. For example, at the rigidity of frame less than about −0.3, when it is possible to keep the rigidity level by using members for enforcement in combination, the aperture ratio in such a case may be calculated, and the range of aperture ratio q may be set to 0.2 or less.

Next, whether the calculated aperture ratio satisfies a predetermined condition is determined (step S11). For example, whether aperture ratio q falls within the range of 0.2 or less is determined, and when the condition is satisfied, the flow proceeds to step S13.

Then, the aperture regions thus set are set as an opening (step S13) to end the flow (end).

On the other hand, when the calculated aperture ratio does not satisfy the predetermined condition in step S11, it is determined that a designing error occurs because the frame strength does not satisfy the condition (step S12).

Following this flow, it is possible to design a frame which is an interior member that controls noise from an apparatus main body of an image forming apparatus.

In the foregoing, description has been made for a color printer which is an image forming apparatus; however, an MFP (Multifunction Peripheral), a facsimile device, and the like may be recited as well, without limited to the above. As to the method of designing a frame as described above, a program for causing a computer to execute the control as described in the above flow may be provided. Such a program may be provided as a program product in which the program is recorded in computer readable recording media such as a flexible disc belonging to a computer, a CD-ROM (Compact Disc-Read Only memory), a ROM (Read Only Memory), a RAM (Random Access Memory) and a memory card. Alternatively, the program may be provided while recorded in a recording medium such as a hard disc incorporated in a computer. The program may be provided through downloading over networks.

The program may be so configured that a necessary module is read and executed in specific sequence at specific timing from program modules provided as part of an operation system (OS) of a computer. In such a case, the above module is not contained in the program itself, and the processing is executed in cooperation with the OS. Such a program that does not contain the module may be embraced in the program according to the present invention.

Further, the program may be provided while it is incorporated as part of another program. Also in such a case, the module contained in the another program is not contained in the program itself, and the processing is executed in cooperation with the another program. Also such a program that is incorporated in another program may be embraced in the program according to the present invention.

The provided program product is executed while installed in a program storage such as a hard disc. It is to be noted that the program product includes the program itself and a recording medium on which the program is recorded.

Although the present invention has been described and illustrated in detail, it is clearly understood that the same is by way of illustration and example only and is not to be taken by way of limitation, the scope of the present invention being interpreted by the terms of the appended claims.

What is claimed is:

1. An image forming apparatus comprising:

an exterior member for controlling noise from an apparatus main body; and an interior member to be mounted with an internal device that generates noise or vibration, the internal device constituting said apparatus main body, wherein said interior member is disposed at a predetermined interval with respect to said exterior member, and has an opening for allowing sound radiated from said internal device to said exterior member and reflected, to transmit toward said apparatus main body wherein a ratio of area of the opening relative to an entire area of the interior member is set at 0.2 or less.

2. The image forming apparatus according to claim 1, wherein said opening is provided near said internal device.

3. A method of designing a frame to be mounted with an internal device constituting an apparatus main body and generating noise or vibration, inside an exterior member of an image forming apparatus, the method comprising the steps of:

extracting regions where no parts are arranged in said frame;

extracting a region from which an internal noise source is visible according to arrangement of parts when an aperture is made in said frame;

excluding the region from which an internal noise source is visible from the regions where no parts are arranged, to identify a functionally inessential region; and designing an opening in said functionally inessential region, wherein said step of designing an opening includes the steps of:

setting an aperture region in said functionally inessential region;

calculating an aperture ratio of said set aperture region relative to the entire area of said frame;

simulating a sound pressure level to be attenuated based on said calculated aperture ratio;

determining whether or not said simulated sound pressure level to be attenuated satisfies a predetermined condition;

when the sound pressure level to be attenuated satisfies the predetermined condition as a result of said simulation, determining whether or not the set aperture ratio of the aperture region falls within a predetermined range according to a strength condition of said frame; and when the set aperture ratio of the aperture region is within the predetermined range, setting said set aperture region as said opening.

4. A computer readable recording medium storing a program for causing a computer to execute processes to design a frame to be mounted with an internal device constituting an apparatus main body and generating noise or vibration, inside an exterior member of an image forming apparatus, the processes comprising the steps of:

extracting regions where no parts are arranged in said frame;

extracting a region from which an internal noise source is visible according to arrangement of parts when an aperture is made in said frame;

excluding the region from which an internal noise source is visible from the regions where no parts are arranged, to identify a functionally inessential region; and designing an opening in said functionally inessential region, wherein said step of designing an opening includes the steps of:

setting an aperture region in said functionally inessential region;

calculating an aperture ratio of said set aperture region relative to the entire area of said frame;

simulating a sound pressure level to be attenuated based on said calculated aperture ratio;

determining whether or not said simulated sound pressure level to be attenuated satisfies a predetermined condition;

when the sound pressure level to be attenuated satisfies the predetermined condition as a result of said simulation, determining whether or not the set aperture ratio of the aperture region falls within a predetermined range according to a strength condition of said frame; and when the set aperture ratio of the aperture region is within the predetermined range, setting said set aperture region as said opening.

* * * * *